US011679845B2

(12) United States Patent
Clark et al.

(10) Patent No.: US 11,679,845 B2
(45) Date of Patent: Jun. 20, 2023

(54) INFLATABLE TANDEM SURF BODYBOARD

(71) Applicant: TANDM Inc., San Clemente, CA (US)

(72) Inventors: John Clark, San Clemente, CA (US); Manya Clark, San Clemente, CA (US); Alleanna Clark, San Clemente, CA (US); Juliette Clark, San Clemente, CA (US); Lyla Clark, San Clemente, CA (US)

(73) Assignee: TANDM Inc., San Clemente, CA (US)

( * ) Notice: Subject to any disclaimer, the term of this patent is extended or adjusted under 35 U.S.C. 154(b) by 197 days.

(21) Appl. No.: 17/366,016

(22) Filed: Jul. 1, 2021

(65) Prior Publication Data

US 2022/0009598 A1 Jan. 13, 2022

Related U.S. Application Data

(60) Provisional application No. 62/705,600, filed on Jul. 7, 2020.

(51) Int. Cl.

| | |
|---|---|
| ***B63B 32/51*** | (2020.01) |
| ***F04B 37/00*** | (2006.01) |
| ***B63B 32/77*** | (2020.01) |

(52) U.S. Cl.

CPC ..... *B63B 32/51* (2020.02); *B63B 32/77* (2020.02); *F04B 37/00* (2013.01)

(58) Field of Classification Search

CPC ..... B63B 32/00; B63B 32/20; B63B 32/22; B63B 32/50; B63B 32/51; B63B 32/57; B63B 32/59; B63B 32/60; B63B 32/77; F04B 37/00; F04B 41/00

USPC ..... 441/65, 66, 74, 79

See application file for complete search history.

(56) References Cited

U.S. PATENT DOCUMENTS

| | | | | |
|---|---|---|---|---|
| 5,389,023 | A | 2/1995 | McIntyre | |
| 7,074,098 | B1 | 7/2006 | Acosta, Jr. | |
| 7,144,258 | B2 | 12/2006 | Hendricks | |
| 7,660,006 | B2 | 2/2010 | Mollis | |
| 7,662,006 | B2 * | 2/2010 | Mollis | B63B 32/51 441/74 |
| 8,150,248 | B1 | 4/2012 | Woodman | |
| 9,114,862 | B2 * | 8/2015 | Dingel | B63B 32/51 |
| 9,513,535 | B2 | 12/2016 | Bennett et al. | |
| 9,694,540 | B2 | 7/2017 | Trockel | |
| 10,479,449 | B2 | 11/2019 | Cooper | |
| 10,526,057 | B2 * | 1/2020 | Kohnsen | B63B 32/51 |
| 10,611,443 | B2 | 4/2020 | MacDonald | |

(Continued)

*Primary Examiner* — Daniel V Venne

(74) *Attorney, Agent, or Firm* — H. Brock Kolls

(57) ABSTRACT

The present invention relates to an inflatable tandem surf bodyboard, methods of making, and a kit that includes a tandem surf bodyboard, an air pump, a maintenance kit, and a carry bag. The tandem surf bodyboard can accommodate more than one rider, allowing two riders to share and surf a wave. The inflatable tandem surf bodyboard comprises a base that is cut into the shape of a surf bodyboard, a base fabric layer is applied over the base, an intermediate portion material forms an air chamber, an upper layer is fastened to the intermediate portion material, a deck pad layer is applied over the upper layer, a first rail layer is applied around the perimeter of the surf bodyboard sealing the edges, and a second rail layer is applied over the first rail layer. An air inlet allows the tandem surf bodyboard to be inflated.

20 Claims, 10 Drawing Sheets

(56) References Cited

U.S. PATENT DOCUMENTS

| | | | | |
|---|---|---|---|---|
| 10,814,939 | B2 * | 10/2020 | Köhnsen | B63B 32/64 |
| 2005/0247248 | A1 | 11/2005 | Caplan et al. | |
| 2017/0008602 | A1 | 1/2017 | Hoge, Jr. | |

* cited by examiner

INFLATABLE TANDEM SURF BODYBOARD

CROSS-REFERENCE TO RELATED APPLICATIONS

This application contains subject matter which is related to the subject matter of the following co-pending application. The below-listed application is hereby incorporated herein by reference in its entirety:

This is a U.S. non-provisional application that claims the benefit of a U.S. provisional application, Ser. No. 62/705,600, inventor John Clark, entitled "TANDEM BOOGIE™ PORTABLE INFLATABLE BODYBOARD", filed Jul. 7, 2020.

TECHNICAL FIELD OF THE INVENTION

The present invention relates to an inflatable surf bodyboard, and more particularly to an inflatable surf bodyboard that two people can simultaneously ride when surfing waves.

BACKGROUND OF THE INVENTION

Before our invention, bodyboards were short rectangular pieces of polyethylene or polypropylene foam core with a top deck, side rails, and a bottom skin. A shortcoming is the bodyboards are too small for the average-sized person to be able to catch and surf waves. It is reported that the original size of bodyboards was determined by cost-effective shipping rates offered by the US Postal Service. Another shortcoming is that bodyboards are not designed based on what would work well for an average-sized adult. In this regard, catching waves with a typical bodyboard can be difficult and frustrating for most adults.

Though large-sized foam boards will accommodate an adult user, large-sized foam boards take up a lot of space and are difficult to store and transport to the ocean.

Furthermore, bodyboards are designed for use by just one person. Many people also do not have the skill or the confidence to learn how to catch waves alone. Currently, the only way for two people to catch and surf waves together is with a full-length surfboard. Surfboards are narrow and difficult for average-sized people to ride together and don't lend themselves very well to body surfing.

For these reasons and shortcomings as well as other reasons and shortcomings, there is a long-felt need for a tandem rider surf bodyboard that is convenient to ship, store, and carry which gives rise to the present invention.

SUMMARY OF THE INVENTION

The shortcomings of the prior art are overcome and advantages are provided through the provision of an inflatable tandem surf bodyboard comprising a base that is cut into the shape of a surf bodyboard and a base fabric layer applied over and secured to the top side of the base.

The inflatable tandem surf bodyboard further comprises an intermediate portion material that forms an air chamber defined by the circumference of the intermediate portion material. The intermediate portion material bottom side is affixed to the base fabric. The air chamber is traversed by a plurality of drop-stitches that fix or otherwise set the inflatable dimensions of the air chamber allowing higher air pressures that increase the buoyance and rigidity of the inflatable tandem surf bodyboard.

Continuing, an upper layer is fastened to the top side, right side, and left side of the intermediate portion material, and a deck pad layer is applied over and secured to the outer surface of the upper layer. A first rail layer is applied around the perimeter of the surf bodyboard sealing edges of the base, the base fabric layer, the upper layer, and the deck pad layer, and a second rail layer is applied over the first rail layer around the perimeter of the surf bodyboard.

Additional shortcomings of the prior art are overcome and additional advantages are provided through the provision of an inflatable tandem surf bodyboard kit comprising an air pump, and a surf bodyboard. The surf bodyboard comprising a base that is cut into the shape of a surf bodyboard having a top, a bottom, a left side, and a right side, a front section, a middle section, and a back section. The front section having a leading edge, and the back section having an inward curvature edge proximate to the perimeter between the left side and the right side.

The inflatable tandem surf bodyboard further comprises a base fabric layer that is applied over and secured to the top side of the base. An intermediate portion material forms an air chamber that is defined by the circumference of the intermediate portion material. The intermediate portion material bottom side is affixed to the base fabric. The air chamber is traversed by a plurality of drop-stitches that fix or otherwise set the inflatable dimensions of the air chamber allowing higher air pressures that increase the buoyance and rigidity of the surf bodyboard.

Continuing, an upper layer is fastened to the top side, right side, and left side of the intermediate portion material, and a deck pad layer is applied over and secured to the outer surface of the upper layer. A first rail layer is applied around the perimeter of the surf bodyboard sealing edges of the base, the base fabric layer, the upper layer, and the deck pad layer. A second rail layer is applied over the first rail layer around the perimeter of the surf bodyboard.

An air inlet is located in the front section proximate to the leading edge. The air inlet is accessible externally and traverses the deck pad layer, the upper layer, and portion of the intermediate portion material entering the air chamber. The air inlet having a connector for securely connecting the air pump. The air inlet is securable in an airtight manner by way of a removable cover.

Additional shortcomings of the prior art are overcome and additional advantages are provided through the provision of a method of making an inflatable tandem surf bodyboard comprising the steps of cutting a base into the shape of a surf bodyboard, and applying a base fabric layer over and securing the base fabric layer to the top side of the base.

The method further comprises the step of forming an air chamber by way of an intermediate portion material. The air chamber is defined by the circumference of the intermediate portion material. The intermediate portion material bottom side is affixed to the base fabric. The air chamber is traversed by a plurality of a drop-stitch that fix or otherwise set the inflatable dimensions of the air chamber allowing higher air pressures that increase the buoyance and rigidity of the inflatable tandem surf bodyboard.

The method continuing by fastening an upper layer to the top side, right side, and left side of the intermediate portion material, and applying a deck pad layer over and securing the deck pad layer to the outer surface of the upper layer. A first rail layer is applied around the perimeter of the surf bodyboard sealing edges of the base, the base fabric layer, the upper layer, and the deck pad layer. A second rail layer is applied over the first rail layer around the perimeter of the surf bodyboard.

Additional features and advantages are realized through the techniques of the present invention. Other embodiments and aspects of the invention are described in detail herein and are considered a part of the claimed invention. For a better understanding of the invention with advantages and features, refer to the description and the drawings.

BRIEF DESCRIPTION OF THE FIGURES

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

Figure 1:
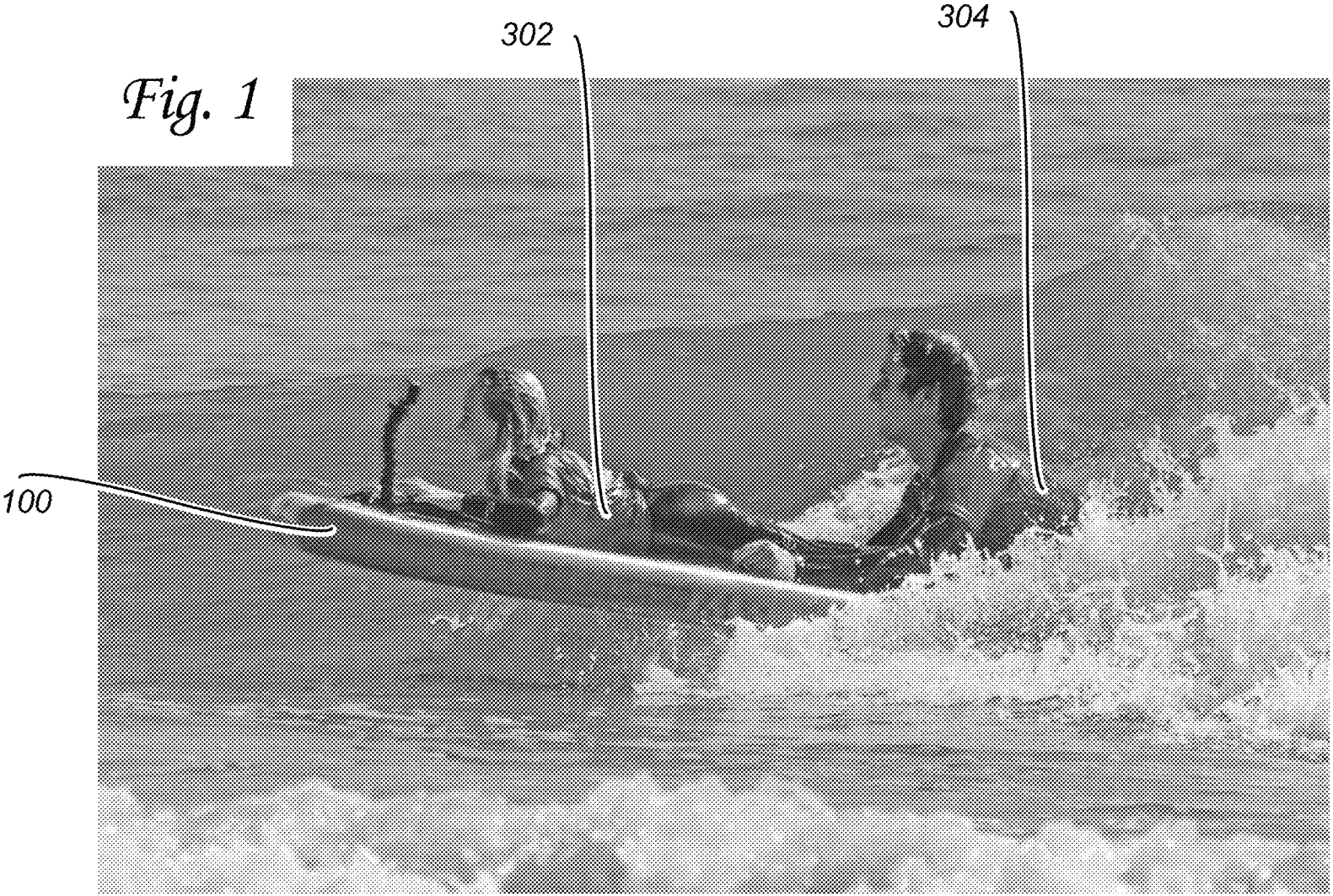
FIG. 1 illustrates one example of an inflatable tandem surf bodyboard being ridden by two riders.

The detailed description explains the preferred embodiments of the invention, together with advantages and features, by way of example with reference to the drawings.

DETAILED DESCRIPTION OF THE INVENTION

The tandem surf bodyboard can accommodate more than one rider, allowing two riders to share one board and surf a wave. Prior to the present invention, the only way for two people to catch and surf waves together was on a long surfboard. However, surfboards are narrow in dimension and difficult for average-sized people to mount, ride, and control in the surf together. In addition, surfboards are not well adapted for body surfing.

The inflatable tandem surf bodyboard, of the present invention, provides a construction that is more buoyant, easier for dual riders to mount, easier to maneuver and steer in the surf, and better adapted for the needs of multiple body surfing riders versus a surfboard. The inflatable tandem surf bodyboard is constructed, sized, and arranged for use by two people at a time to catch and surf waves together, regardless of skill or ability.

In an exemplary embodiment, while not in use, the inflatable tandem surf bodyboard, of the present invention, can be rolled up and stored in a carry bag, making it easy to transport to the beach. In this regard, a person can conveniently carry the inflatable tandem surf bodyboard in a small carry bag. Traveling to the beach or other man-made wave destinations, a person can then inflate the tandem surf bodyboard with an air pump for use. At the end of their stay, the tandem surf bodyboard can be deflated and stored back in the carry bag.

The inflatable tandem surf bodyboard design and construction are based on inflatable drop-stitch technology. Drop-stitch technology uses a plurality of threaded stitches between at least two layers of material that are held separated by a fixed or set distance or dimension. The length of the drop-stitches set the inflated distance between the layers. The drop-stitched layers are formed into an air chamber that is embedded into the tandem surf bodyboard. Inflated, the drop-stitches hold the air chamber at the fixed or otherwise set drop-stitch length dimension and as such the air chamber can accept higher air pressures which creates a more rigid inflated structure that is fit for purpose as a tandem surf bodyboard. Deflated the tandem surf bodyboard is easily folded or rolled up to save space and fit into a carry bag. The drop-stitch material can be nylon, polymer, Kevlar, or other types and kinds of drop-stitch thread material, as may be required and/or desired in a particular embodiment.

An advantage, in the present invention, is that in operation a rider can inflate the tandem surf bodyboard just prior to use. In use, the tandem surf bodyboard is large which creates more buoyancy lifting the riders higher out of the water reducing drag which allows the riders to position themselves within the wave to maximize the ride distance, speed, and experience. The tandem surf bodyboard is designed to be larger than a typical bodyboard so it floats two people at one time.

Another advantage, in the present invention, is the positioning of the comfort grip handles angle and proximity to the corners of the tandem surf bodyboard. In this regard, in addition to hanging onto the tandem surf bodyboard during the ride, both a first rider and a second rider can control the direction of motion as they surf. Such directional control is effectuated by away of the riders applying pressure to the corners of the tandem surf bodyboard causing the tandem surf bodyboard to press into the surf in a manner that changes the directional attitude of the tandem surf bodyboard.

Turning now to the drawings in greater detail, it will be seen that in FIG. 1 there is one example of an inflatable tandem surf bodyboard being ridden by two riders. In an exemplary embodiment, gripping the comfort handles located in the front section, a first rider 302 in the prone position can ride in a forward section of the tandem surf bodyboard 100. With the first rider in position gripping the comfort grip handles in the back section a second rider 304 in the prone position can join the first rider in catching and surfing a wave.

The inflatable design in combination with the drop-stitch construction technique creates a rigid surf bodyboard that rides on top of the surf even when loaded with the weight of two riders 302 and 304. Reducing drag in the water, the tandem body bodyboard 100 is easily pushed through the surf by the energy of the wave, creating a higher speed, longer distance, and more enjoyable surf ride for riders 302 and 304.

Figure 2:
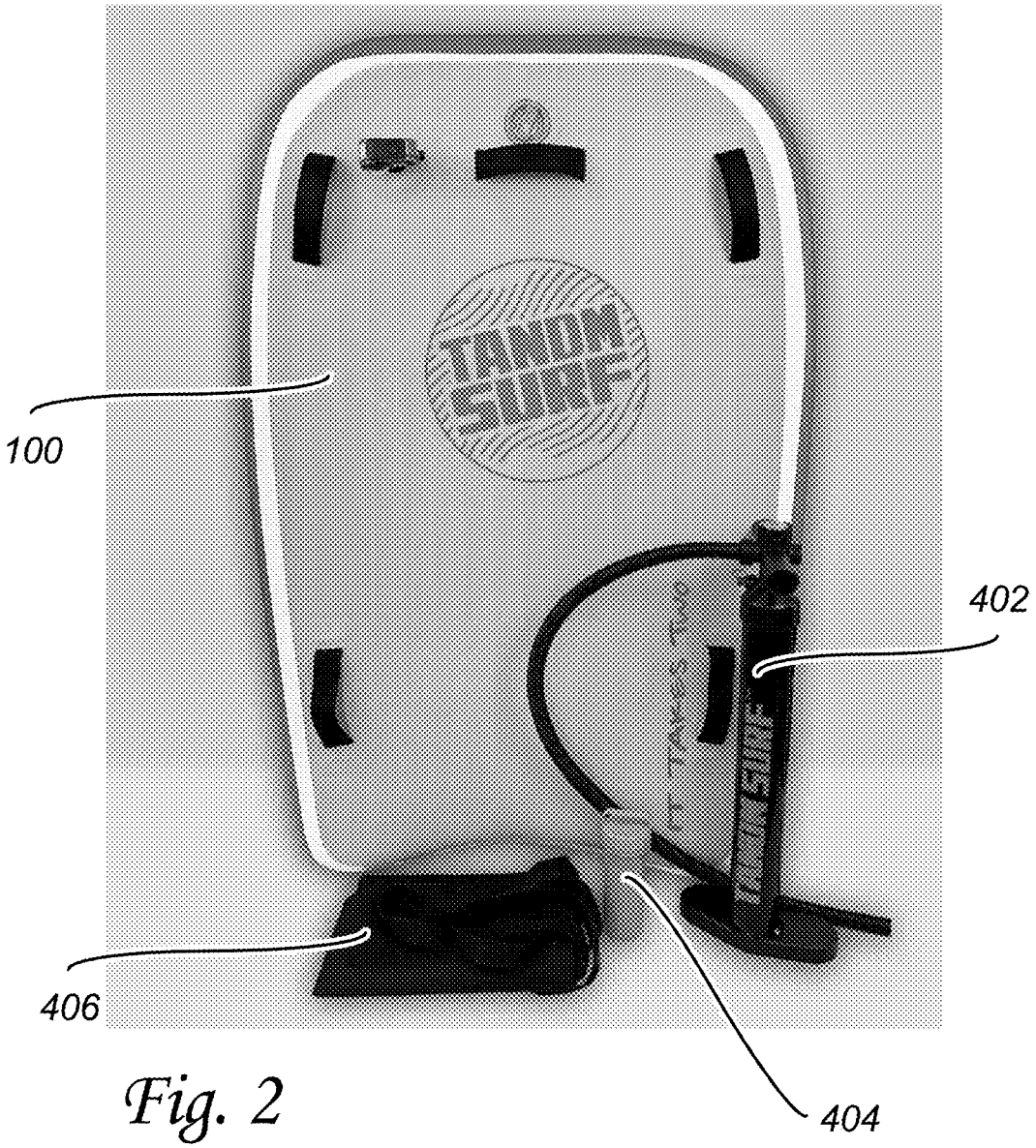
FIG. 2 illustrates one example of an inflatable tandem surf bodyboard kit.

Referring to FIG. 2, there is illustrated one example of an inflatable tandem surf bodyboard kit. In an exemplary embodiment, the inflatable tandem surf body kit can comprise a tandem surf bodyboard 100 and an air pump 402 for inflating the tandem surf bodyboard 100. In other exemplary embodiments, the inflatable tandem surf body kit can further comprise a maintenance kit 404 for repairing and maintaining the tandem surf bodyboard and carry bag 406 for storing and carrying a deflated tandem body surfboard 100, the air pump 402, and the maintenance kit 404. The maintenance kit can further comprise a tandem body surfboard air leak repair patch kit, tools such as scissors or a knife to cut the repair patch material, and other maintenance items, as may be required and/or desired in a particular embodiment.

The air pump 402 has a hose through which pumped air is delivered into the air chamber 144 by way of an air inlet 104. The hose is adapted to mate with the air inlet 104. The air inlet 104 having a valve to retain pressurized air inside the air chamber 144.

Figure 3:
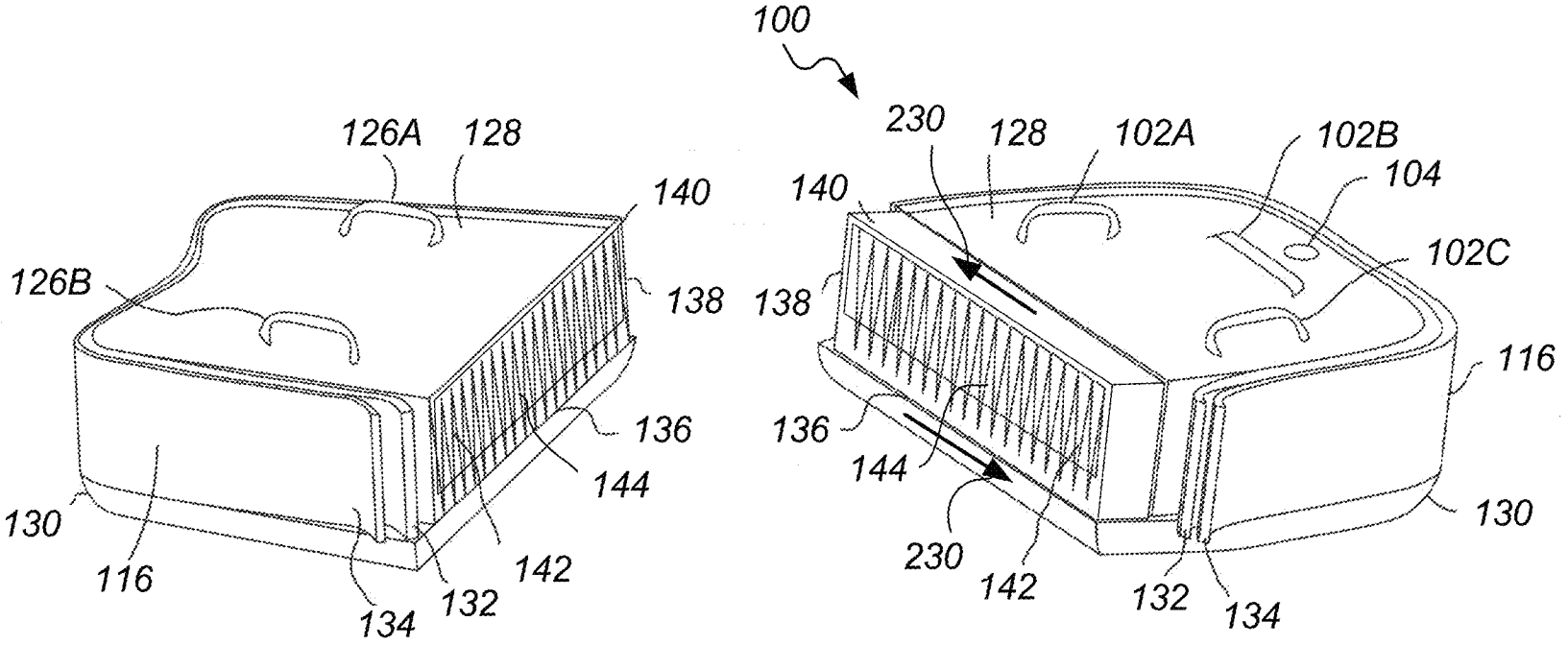
FIG. 3 illustrates one example of a cross-sectional view of an inflatable tandem surf bodyboard.

Referring to FIG. 3, there is illustrated one example of a cross-sectional view of an inflatable tandem surf bodyboard 100. In an exemplary embodiment, the inflatable tandem surf bodyboard 100 can comprise a base 130. The base 130 can be made of a durable puncture and scuff resistant rubber, polyvinyl chloride (PVC), or other similar materials, as may be required and/or desired in a particular embodiment.

The base 130 is cut into the desired shape of the tandem surf bodyboard 100 and a base fabric layer 136 is applied over and secured to the top side of the base 130. An intermediate portion material 138 forms an air chamber 144 that is defined by the circumference of the intermediate portion material 138. The intermediate portion material 138 bottom side is affixed to the base fabric 136. The air chamber 144 is traversed by a plurality of drop-stitches 142 that fix or otherwise set the inflatable dimensions of the air chamber 144 allowing higher air pressures that increase the buoyance and rigidity of the tandem surf bodyboard 100. The intermediate portion material 138 can be manufactured from flexible materials that can be sewn together. Such flexible material can include, for example and not a limitation, PVC, canvas, Kevlar, rubber, and other types and kinds of flexible materials, as may be required and/or desired in a particular embodiment.

An upper layer 140 is fastened to the top side, right side, and left side of the intermediate portion material 138. A deck pad layer 125 is applied over and secured to the outer surface of the upper layer 140. The upper layer 140 can be made of a durable puncture and scuff resistant rubber, PVC, or other similar materials, as may be required and/or desired in a particular embodiment. The deck pad layer 125 can be made of a durable puncture and scuff resistant rubber, PVC, ethylene vinyl acetate (EVA), or other similar types or kinds of materials, as may be required and/or desired in a particular embodiment.

A first rail layer 132 is applied around the perimeter of the tandem surf bodyboard 100. A second rail layer 134 is applied over the first rail layer 132 around the perimeter of the tandem surf bodyboard 100. The first rail layer 132 and the second rail layer 134 can be made of a durable puncture and scuff resistant rubber, PVC, or other similar materials, as may be required and/or desired in a particular embodiment.

In an exemplary embodiment, to create a dynamic air design, the drop-stitch 142 can be sewn in a manner to form a V-shaped stitching pattern that is vertically orientated across air chamber 144. In this regard, the V-shaped stitching between layers provides structural support that reduces the inclination of the sewn materials to shear laterally with respect to one another providing a more durable and stable surfing surface, illustrated as 230. Said differently, the V-shape stitching provides engineered strength, in its triangle stitched orientation, that reduces the shear forces 230 and resultant motion between the air chamber upper and lower sewn layers. Doing so provides a more rigid and stable tandem surf bodyboard during use and under the force of the water and waves, and the weight load of the riders during surfing.

In an exemplary embodiment, in manufacture, the intermediate portion material 138 and other materials can be cut into the shape of the tandem surf bodyboard 100. Seam tape can be used to glue along the inside seam to create an airtight air chamber 144. The tandem surf bodyboard 100 can then be inflated and the first rail layer 132 then the second rail layer 134 attached. A plurality of comfort grip handles including more than one first rider handles 102A, 102B, and 102C that are accessible to the first rider 302 and more than one second rider handles 126A and 126B that are accessible to the second rider 304. The ends of the first rider handle 102A, 102B, and 102C, and the ends of the second rider handles 126A and 126B are fastened to the upper layer 140. The EVA deck pad 128 covers the upper layer 140 including the ends of the first rider handle 102A, 102B, and 102C, and the second rider handles 126A and 126B.

An advantage of the inflatable air design, in the present invention, is that it allows the board to be kept flat and rolled up in a small space, so it is light and easy to transport. The inflation of air inside the tandem surf bodyboard can be effectuated through an air inlet 104. The air inlet 104 having a valve to retain pressurized air inside the air chamber. In one embodiment, the tandem surf bodyboard 100 by way of air pump 402 can be inflated before use within a range of 5 pounds per square inch (psi) to 20 psi, in a preferred range of 7 psi to 13 psi, and most preferably 10 psi.

An advantage, in the present invention, is that the tandem surf bodyboard 100 is very rigid and stable to ride. This is achieved by reducing the lateral motion between the top and bottom layers resultant from shear forces 230 using a combination of air inflate air pressures of 10 psi or greater and drop-stitching 142 sewn in a structurally engineered V-shaped stitching pattern vertically orientated across the air chamber 144. The drop-stitching 142 sets the inflatable dimensions allowing higher air inflate pressures and the engineered triangle V-shape stitching pattern reduces the lateral motion 230 between the top and bottom layers resultant from shear forces that occur with rider 302 and 304 weight transfer when mounting, leaning, and riding the tandem surf bodyboard 100.

In an exemplary embodiment, the tandem surf bodyboard 100 dimensions can be in the range of 27 inches to 45 inches in width and 40 inches to 65 inches in length, and 2.5 to 7 inches in thickness, preferably in the range of 30 inches to 40 inches in width and 45 inches to 58 inches in length, and 3.5 to 5.5 inches in thickness, and most preferably, 34 inches in width, 51 inches in length, and 4.5 inches in thickness.

An advantage, in the present invention, is that manufacturing techniques can produce a tandem surf bodyboard 100 that will hold and float two riders 302 and 304. In one embodiment, the tandem surf bodyboard 100 may include at least one comfort grip rider handle 102 or 126 and an EVA smooth deck pad 128. In another embodiment, five comfort grip rider handles 102A, 102B, 102C, 126A, and 126B can be provided. In another embodiment, the easy-grip rider handles 102A, 102B, 102C, 126A, or 126B are glued or otherwise fastened to the tandem surf bodyboard 100 under the smooth EVA deck pad 128. The arrangement of the five comfort grip rider handles 102A, 102B, 102C, 126A, or 126B provide a place for each rider 302 and 304 to use the handles to hold on to the tandem surf bodyboard 100 when they catch and surf wave. Additionally, riders 302 and 304 can use the rider handles 102A, 102B, 102C, 126A, or 126B to steer the tandem surf bodyboard 100 when riding the wave.

Figure 4:
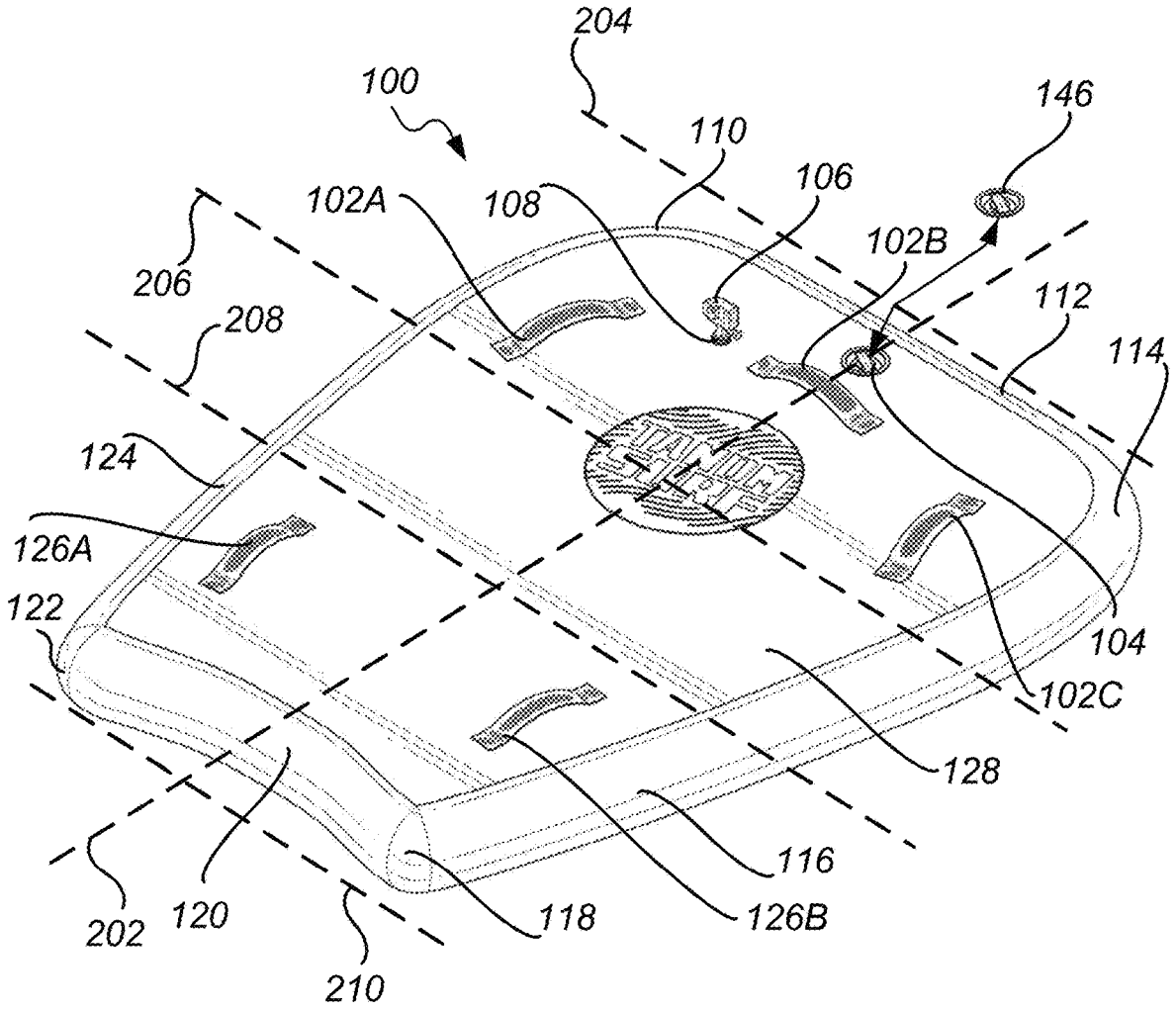
FIG. 4 illustrates one example of a top side perspective view of an inflatable tandem surf bodyboard.

Referring to FIG. 4, there is illustrated one example of a top side perspective view of an inflatable tandem surf bodyboard 100. In an exemplary embodiment, the tandem surf bodyboard 100 can have a top 128, a bottom 130 which is better illustrated in FIG. 5, a left side 124, and a right side 116, a front section between reference lines 204 and 206, a middle section between reference lines 206 and 208, and a back section between reference lines 208 and 210. The front section has a leading-edge 112, and the back section 120 has an inward curvature edge proximate to the perimeter between the 124 left side and the right side 116. The inward curvature edge provides a comfortable edge that meets the second rider's 304 hips, stomach, or chest and is better illustrated in at least FIG. 6 between reference lines as 220.

A central reference line 202 divides the tandem surf bodyboard into a left-hand section and a right-hand section. In an exemplary embodiment, the air inlet 104 can be centrally located proximate the reference line 202 in the front section between reference lines 204 and 206 near the leading edge 112. In a plurality of other exemplary embodiments, there can be more than one air inlet 104 and the location of the air inlet(s) 104 can vary, as may be required and/or desired in a particular embodiment.

The air inlet 104 is accessible externally by the riders and traverses the deck pad layer 128, the upper layer 140, and portions of the intermediate portion material 138 entering the air chamber 144. The air inlet 104 has a connector for securely connecting the hose on the air pump 402. The air inlet 104 having a valve to retain pressurized air inside the air chamber 144. The air inlet 104 is securable by way of a removable and resealable cover 146.

In an exemplary embodiment, a camera mount 108 can be affixed to the surface of the tandem surf bodyboard 100, preferably in the front section between reference lines 204 and 206 through the camera mount can be positioned in other locations. In this regard, a camera 106 can be selectively connected in a removable manner to the tandem surf bodyboard 100. In operation, the camera 100 can record pictures, video, and audio of the riders surfing exploits from the perspective of the tandem surf bodyboard 100. The camera 106 can be a GOPRO, or other type or kind of camera, as may be required and/or desired in a particular embodiment.

In an exemplary embodiment, the tandem surf bodyboard 100 can have contoured corners 110 and 114 that lead into the leading edge 112 proximate to the front section. In addition, the tandem surf bodyboard 100 can have contoured corners 118 and 122 proximate to the back section leading into the inward curvature edge 120.

Figure 5:
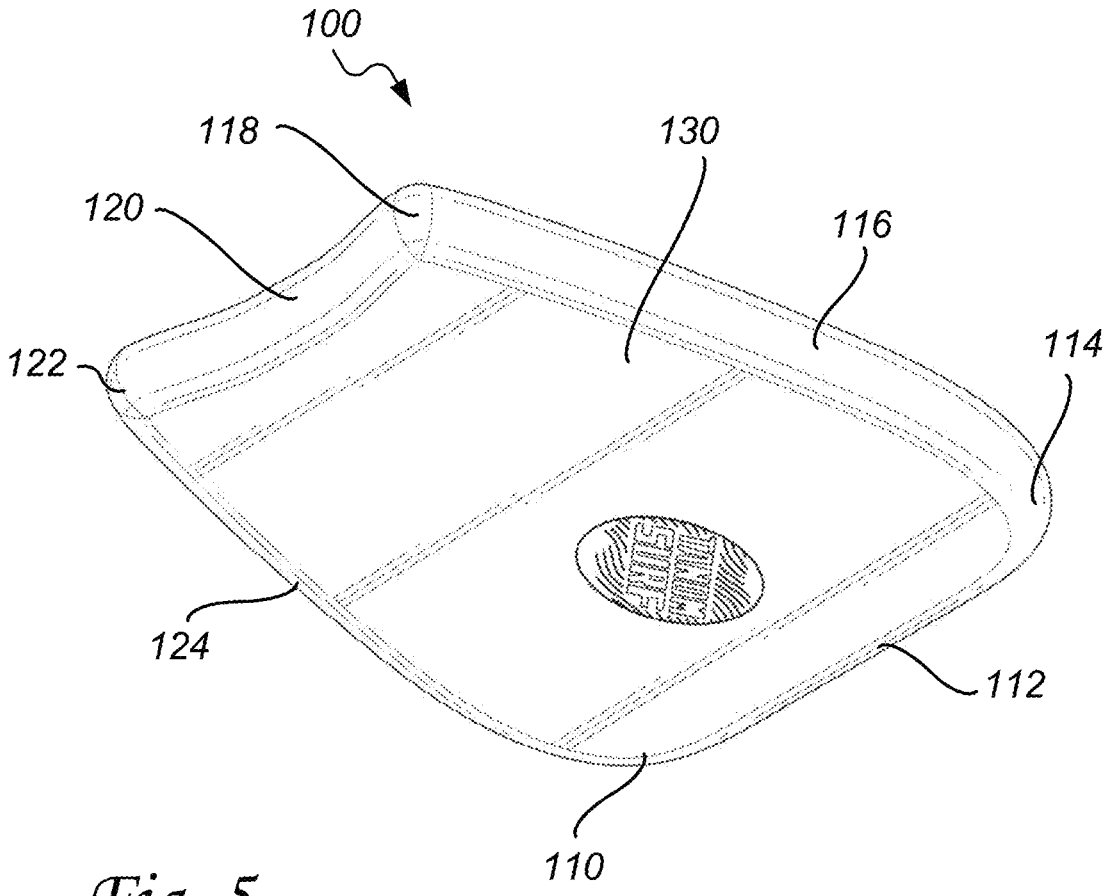
FIG. 5 illustrates one example of a bottom side perspective view of an inflatable tandem surf bodyboard.

Referring to FIG. 5, there is illustrated one example of the bottom side 130 perspective view of the inflatable tandem surf bodyboard 100.

Figure 6:
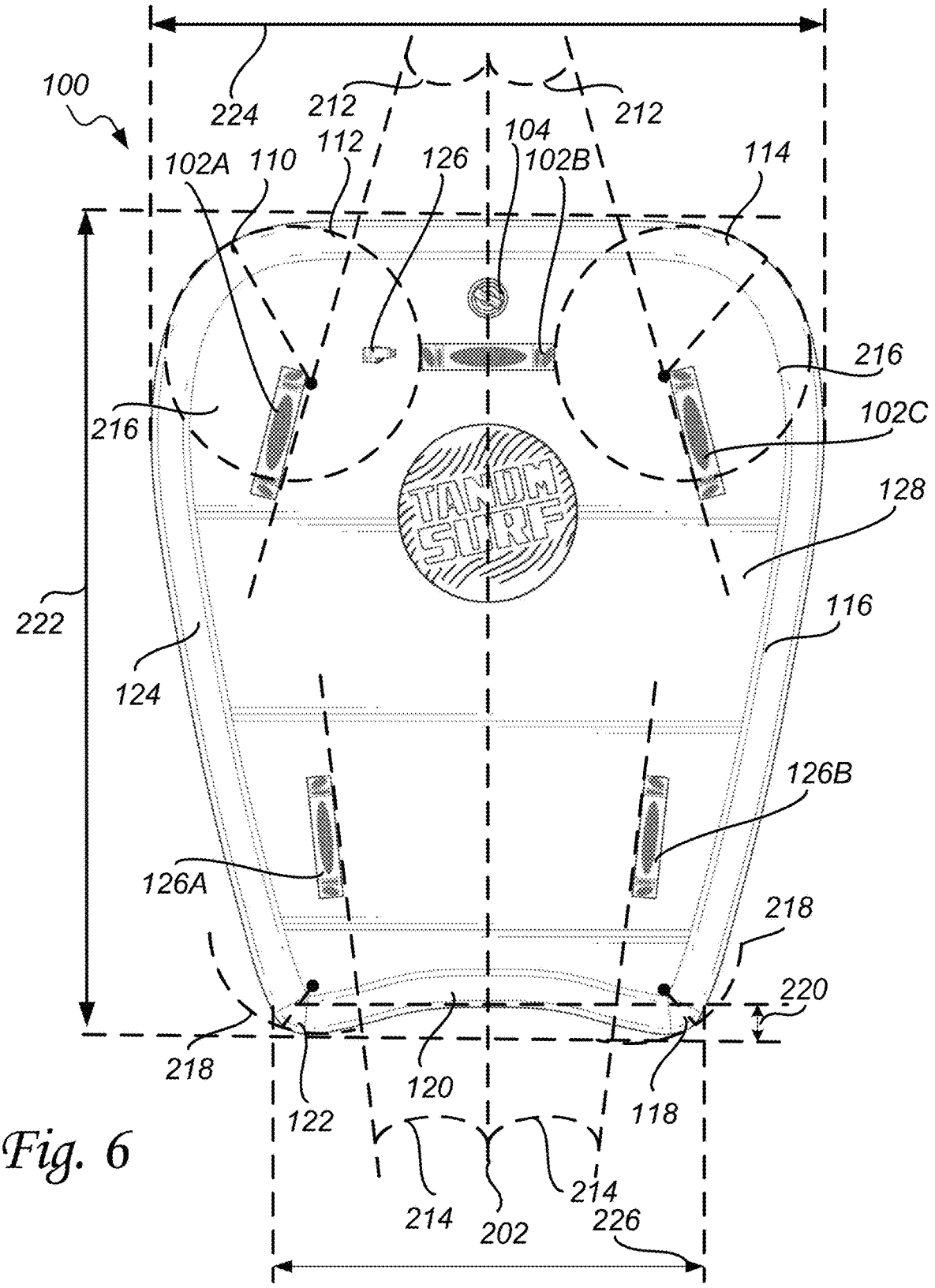
FIG. 6 illustrates one example of a top side view of an inflatable tandem surf bodyboard.

Referring to FIG. 6, there is illustrated one example of the top side view of an inflatable tandem surf bodyboard 100. In an exemplary embodiment, operating together with the first rider handles 102A and 102C in a manner to provide steer-ability in the surf, the contoured corners 110 and 114 are in the radius range 216 of 2 inches to 10 inches, preferably in the range of 4 inches to 8 inches, and most preferably 6 inches in radius. The top of the first rider handles is located proximate to the center of reference circle 216 which defines the radius of the contoured corners 110 and 114.

An advantage, in the present invention, of placing the first rider handles 102A and 102C proximate to the center of reference circle 216 is that while the inflated tandem surf bodyboard 100 is rigid by design, from that handle position the first rider can apply enough of a downward pressure to one or both of the first rider handles 102A or 102B to flex the corresponding contoured curved corner edge 110 or 114 downward into the surf, while riding a wave, just enough to increase the drag on the flexed contoured corner 110 or 114 causing the tandem surf bodyboard 100 to turn in the direction of the flexed contoured corner.

The relationship between the radius 216 and the location of the top edge of the first rider handles 102A and 102C cooperate to create this steer-ability effect. In this regard, if the first rider handles 102A and 102C are placed too close to the edge of the tandem surf bodyboard 110 they would be spread too far apart for the first rider 302 to comfortably reach and still be able to exert a sufficient downward force to effect steering of the tandem surf bodyboard 100. In the alternative, if the first rider handles 102A and 102C are placed too close together then downward force at a first rider handle location would be insufficient to cause the respective contoured edge to flex sufficiently to affect the steering of the tandem surf bodyboard 100. In an exemplary embodiment, the top of the first rider handles 102A and 102C placed at the center of the reference circle 216 that defines the radius of the contoured corners 110 and 114 provide excellent first rider 302 steering control of the tandem surf bodyboard 100.

The first rider handles 102A, 102B, and 102C are fastened at their ends creating a grip portion in the center of their length that the first rider 302 can hold onto with a hand. Each of the first rider handles 102A, 102B, and 102C are in the range of 4 inches to 8 inches in length, preferably in the range of 5 inches to 7 inches in length, and in an exemplary embodiment 6 inches in length. The first rider handles 102A, 102B, and 102C can be made from solid or woven materials such as rope, polymer, Kevlar, plastics, fabrics, and other types and kinds of materials, as may be required and/or desired in a particular embodiment.

An advantage, in the present invention, is that the first rider handles 102A and 102C are positioned at an angle 212 that aligns with the hands and arms position of the first rider 302 while holding onto the handles and riding the tandem surf bodyboard 100. In this regard, the angle of the first rider handles 102A and 102C are measured with respect to the center reference line 202 and are in the range of 5 degrees to 30 degrees, preferably 10 degrees to 20 degrees, and most preferably 13 degrees with respect to the center reference line 202. The angled first rider handles 102A and 102C provide a natural gripping position for the first rider 302 that creates a more enjoyable riding experience. For disclosure purposes, angle 212 can be referred to as the first rider handle offset angle 212.

In an exemplary embodiment, operating together with the second rider handles 126A and 126B in a manner to provide providing steer-ability in the surf, the contoured corners 118 and 122 are in the radius range 218 of 12 inches to 25 inches, preferably in the range 16 inches to 22 inches, and most preferably 19 inches in radius. The inward curvature edge 120 follows the radius edge and extends toward the center reference line 202 creating a smooth contoured inward curvature edge 120 referenced as dimension 220 in the range of 1 inch to 5.5 inches, preferably in the range of 1.25 inches to 3.25 inches, and most preferably 2.25 inches inward curvature edge 120 referenced as dimension 220. The inward curvature edge 220 provides a comfortable edge that meets the second rider's 304 hips, stomach, or chest.

An advantage, in the present invention, of placing the second rider handles 126A and 126B proximate the midway point between reference lines 208 and 210 better illustrated in at least FIG. 4 is that when the second rider 304 grips the second rider handles 126A and 126B their elbows and adjacent forearm are proximate to the reference circles 218. In this configuration, while the inflated tandem surf bodyboard 100 is rigid by design, the second rider 304 can exert enough downward pressure with their forearm on one or both of the contoured edges 118 and 122 to flex the corresponding contoured curved corner edge 118 or 122 downward into the surf, while riding a wave, to increase the drag on the flexed contoured corner 118 or 122 causing the tandem surf bodyboard 100 to turn in the direction of the flexed contoured corner.

The second rider handles 126A and 126B are fastened at the ends creating a grip portion on the middle that the second rider 304 can hold onto with a hand. Each of the second rider handles 126A and 126B are in the range of 4 inches to 8 inches in length, preferably in the range of 5 inches to 7 inches in length, and most preferably 6 inches in length. The second rider handles 126A and 126B can be made from solid or woven materials such as rope, polymer, Kevlar, plastics, fabrics, and other types and kinds of materials, as may be required and/or desired in a particular embodiment.

An advantage, in the present invention, is that the second rider handles 126A and 126B are positioned at an angle 214 that aligns with the hands and arms position of the second rider 304 while holding onto the handles and riding the tandem surf bodyboard 100. In this regard, the angle of the second rider handles 126A and 126B are measured with respect to the center reference line 202 and are in the range of 0 degrees to 20 degrees, preferably 0 degrees to 10 degrees, and most preferably 5 degrees with respect to the center reference line 202. The angled second rider handles 126A and 126B provide a natural gripping position for the second rider 304 that creates a more enjoyable riding experience. For disclosure purposes, angle 214 can be referred to as the second rider handle offset angle 214.

In an exemplary embodiment, the tandem surf bodyboard 100 width reference dimension 224 can be in the range of 27 inches to 45 inches in width, preferably in the range of 30 inches to 40 inches in width, and most preferably 34 inches in width. The length reference dimension 222 can be in the range of and 40 inches to 65 inches in length, preferably 45 inches to 58 inches in length, and most preferably 51 inches in length. Better illustrated in at least FIG. 8, the tandem surf bodyboard 100 thickness reference dimension 228 can be in the range of 2.5 inches to 7 inches in thickness, preferably 3.5 to 5.5 inches thick in thickness, and most preferably 4.5 inches in thickness.

The left side edge 124 forms a smooth curvilinear edge connecting the contoured edges 110 and 122. The right side edge 116 forms a smooth curvilinear edge connecting the contoured edges 114 and 118.

An advantage, in the present invention, is that the peak width 224 of the tandem surf bodyboard 100 occurs proximate to the mid-span of the first rider handles 102A and 102C. In this regard, the first rider 302 can choose to grab the first rider handles 102A and 102C, or the outer edge of the right side and left side edges 116 and 124 of the tandem surf bodyboard 100 when riding. In grabbing the outer edges 116 and 124 the curve and the peak dimension 224 contours into the palms of the first rider's 302 hands. This allows the first rider 302 to grip the board securely and keep it tight to their body when surfing.

Figure 7:
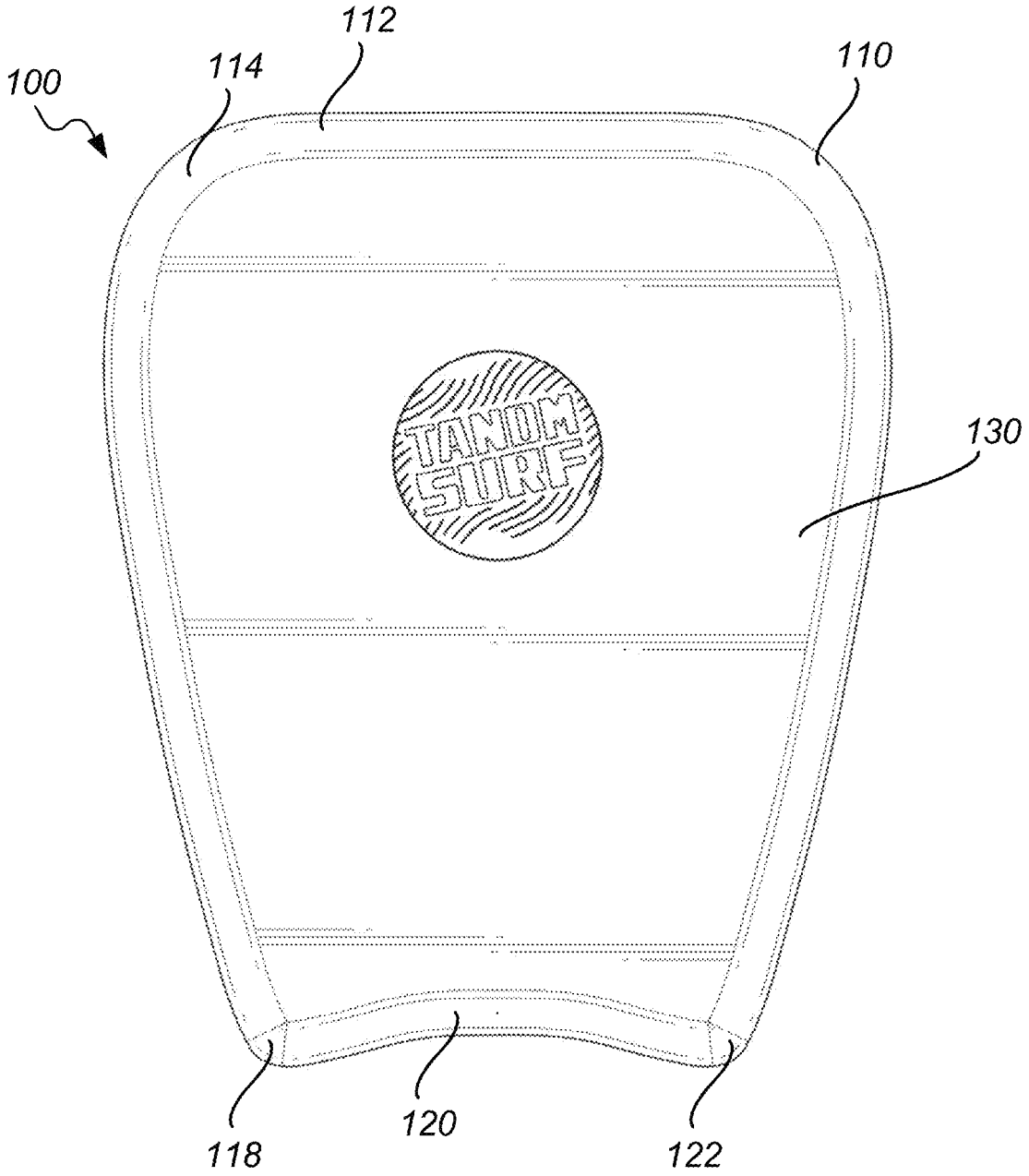
FIG. 7 illustrates one example of a bottom side view of an inflatable tandem surf bodyboard.

Referring to FIG. 7, there is illustrated one example of the bottom side 130 view of the inflatable tandem surf bodyboard 100.

Figure 8:
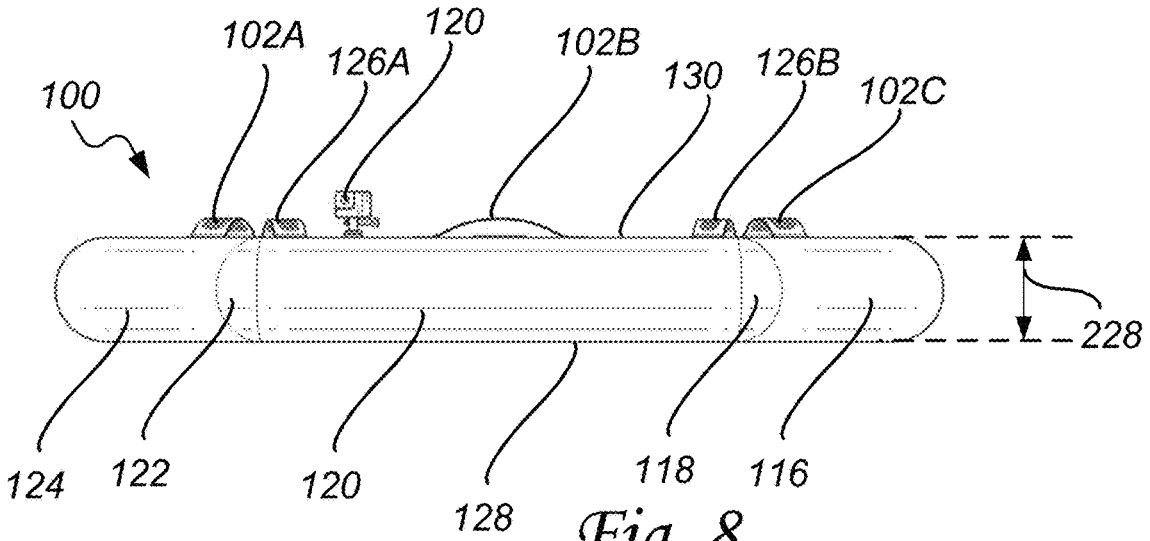
FIG. 8 illustrates one example of a backend view of an inflatable tandem surf bodyboard.

Referring to FIG. 8, there is illustrated one example of the backend view of the inflatable tandem surf bodyboard.

Figure 9:
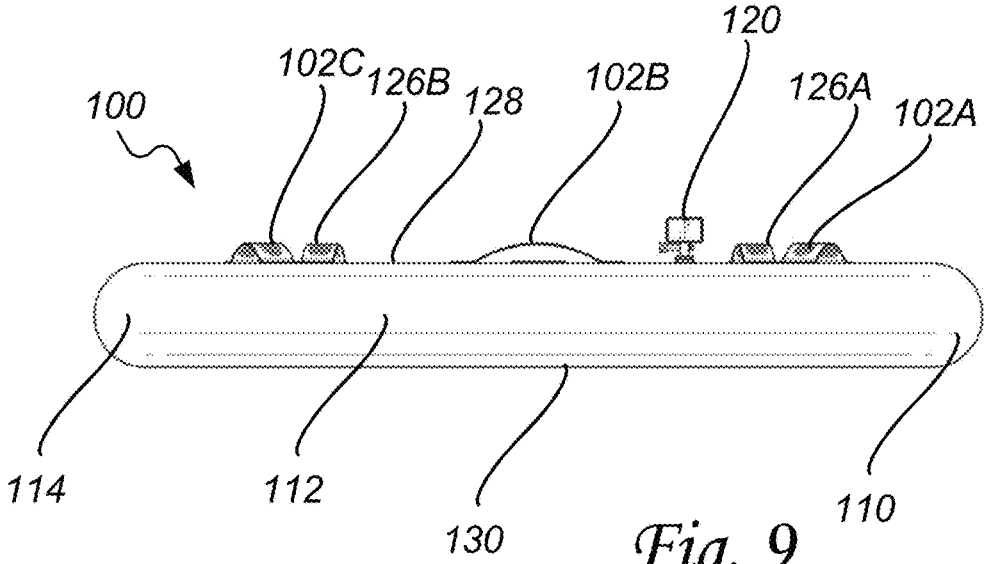
FIG. 9 illustrates one example of a frontend view of an inflatable tandem surf bodyboard.

Referring to FIG. 9, there is illustrated one example of the frontend view of the inflatable tandem surf bodyboard.

Figure 10:
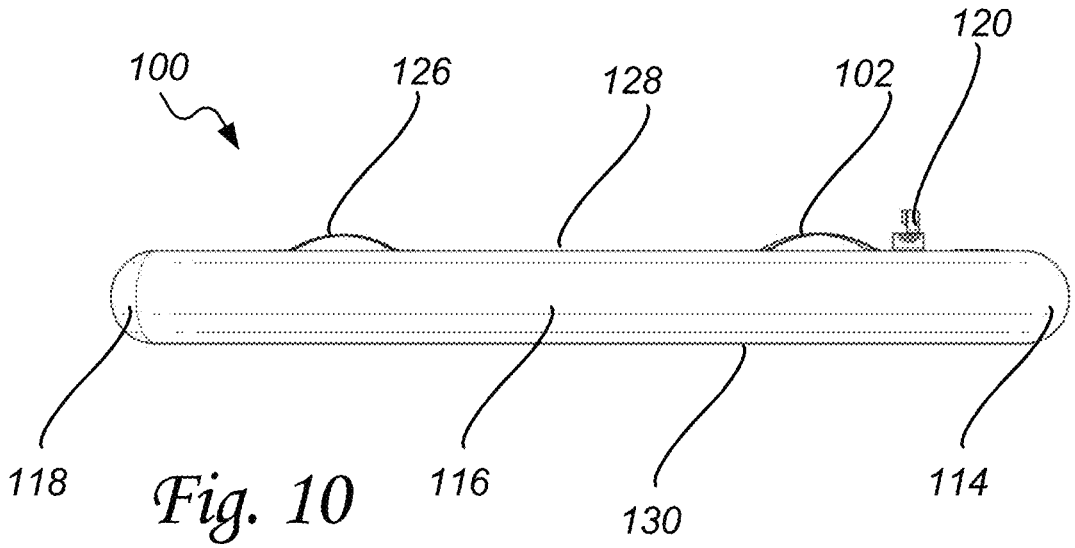
FIG. 10 illustrates one example of a right side view of an inflatable tandem surf bodyboard.

Referring to FIG. 10, there is illustrated one example of the right side view of the inflatable tandem surf bodyboard.

Figure 11:
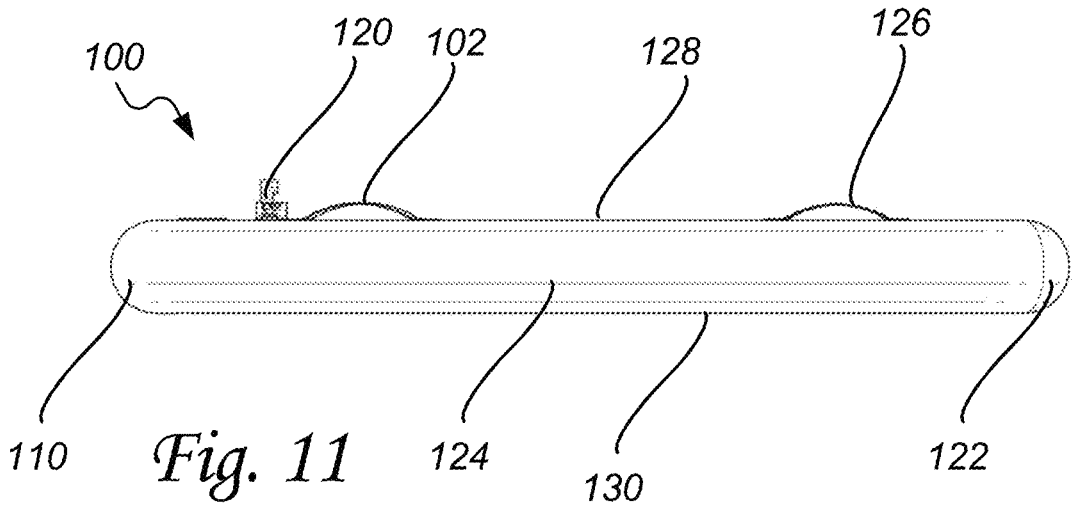
FIG. 11 illustrates one example of a left side view of an inflatable tandem surf bodyboard.

Referring to FIG. 11, there is illustrated one example of the left side view of the inflatable tandem surf bodyboard.

In a plurality of exemplary embodiment, the components and layers of the tandem surf bodyboard 100 can be manufactured from a suitable polymer, Kevlar, plastic, vinyl, PVC, EVA, mesh, foam, rubber, nylon, ropes, or other similar materials, rope, woven materials, plastics, and or types and kinds of materials, as may be required and/or desired in a particular embodiment.

Figure 12:
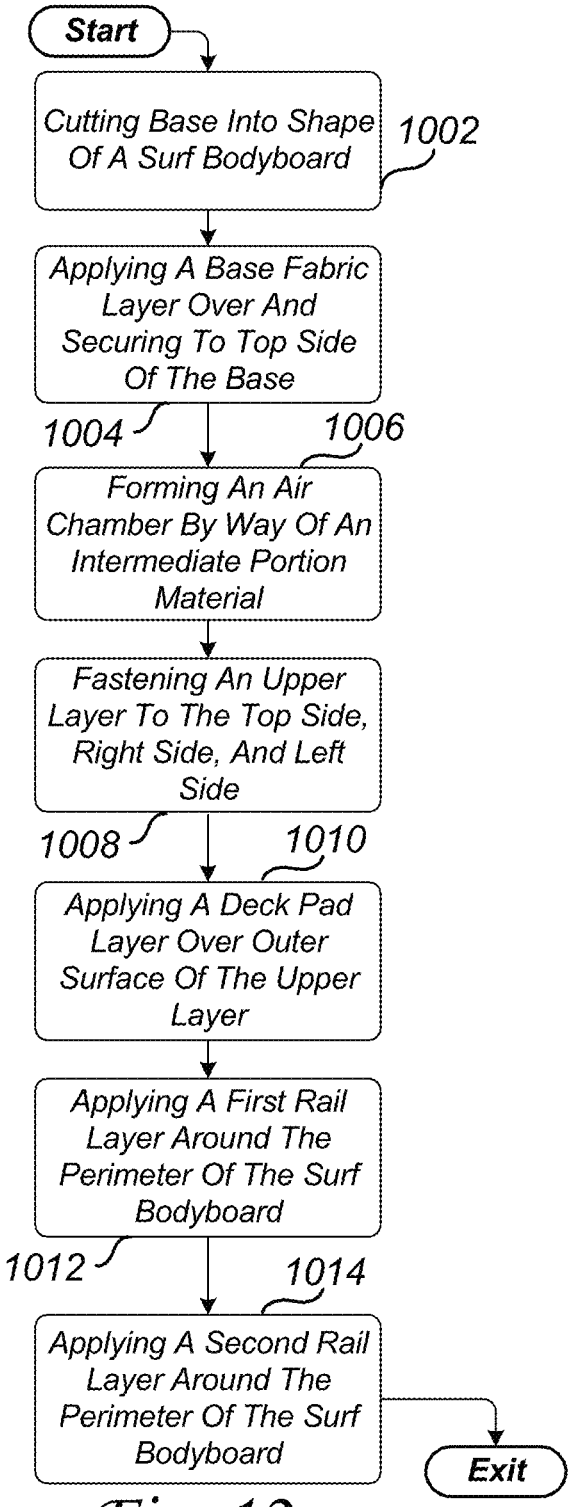
FIG. 12 illustrates one example of a method of making an inflatable tandem surf bodyboard.

Referring to FIG. 12, there is illustrated one example of a method of making an inflatable tandem surf bodyboard 100. In an exemplary embodiment, the method starts in step 1002 where a base 130 can be cut into the shape of a surf bodyboard. In step 1004, a base fabric layer 136 can then be applied over and secured to the top side of the base 130.

The method continues in step 1006 by forming an air chamber by way of an intermediate portion material 138. The air chamber 144 is defined by the circumference of the intermediate portion material 138. The intermediate portion material 138 bottom side is affixed to the base fabric 136. The air chamber 144 is traversed by a plurality of a drop-stitch 142 that fix or otherwise set the inflatable dimensions of the air chamber 144 allowing higher air pressures that increase the buoyance and rigidity of the tandem surf bodyboard 100.

The method moves to step 1008 where an upper layer 140 is fastened to the top side, the right side, and the left side of the intermediate portion material 138. In step 1010, a deck pad layer 128 is applied over and secured to the outer surface of the upper layer 140. In step 1012, a first rail layer 132 is applied around the perimeter of the tandem surf bodyboard 100 sealing the edges of the base 130, the base fabric layer 136, the upper layer 140, and the deck pad layer 128, and in step 1014 a second rail layer 134 is applied over the first rail layer 132 around the perimeter of the tandem surf bodyboard 100. The method is then exited.

Figure 13:
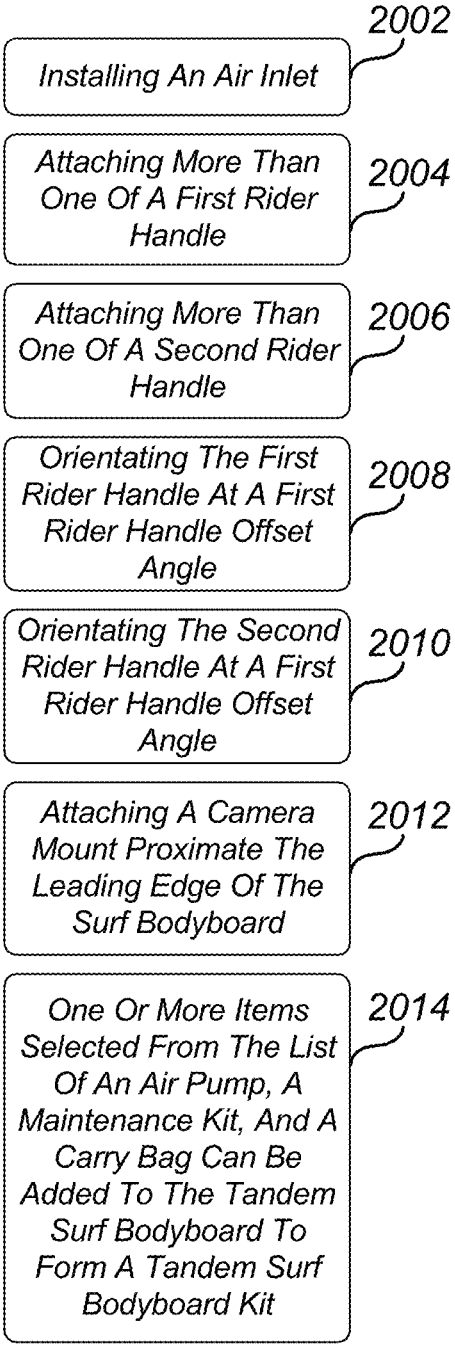
FIG. 13 illustrates exemplary embodiments of a method of making an inflatable tandem surf bodyboard.

FIG. 13 illustrates exemplary embodiments of a method of making an inflatable tandem surf bodyboard.

In step 2002, an air inlet 104 can be installed. In an exemplary embodiment, air inlet 104 is located in the front section proximate to the leading edge 112. In other exemplary embodiments, air inlet 104 can be installed in other locations.

The air inlet 104 is accessible externally and traverses the deck pad layer 128, the upper layer 140, and the portion of the intermediate portion material 138 entering the air chamber 144. The air inlet 104 has a connector for securely connecting the air pump 402. The air inlet 104 having a valve to retain pressurized air inside the air chamber. The air inlet 104 is securable by way of a removable and resealable cover 146.

In step 2004, more than one of the first rider handle 102 can be attached to the tandem surf bodyboard 100. At least one of the first rider handle 102 is orientated horizontally and centrally located in the front section proximate to the leading edge.

At least one of the first rider handle 102 is orientated vertically at a first rider handle offset angle 212 that is adapted to the natural hand and arm position of the first rider 302 in the front section between reference lines 204 and 206 proximate the left side edge 124.

At least one of the first rider handle 102 is orientated vertically at a first rider handle offset angle 212 that is adapted to the natural hand and arm position of the first rider in the front section between reference lines 204 and 206 proximate the right side edge 116. The ends of the first rider handle 102 are fastened to the upper layer 140. The first rider handles 102 are accessible to a first rider 302.

In step 2006, more than one of the second rider handle 126 can be attached to the tandem surf bodyboard 100. At least one of the second rider handle 126 is orientated vertically at a second rider handle offset angle 214 that is adapted to the natural hand and arm position of the second rider 304 in the back section between reference lines 208 and 210 proximate the left side edge 124.

At least one of the second rider handle 126 is orientated vertically at a second rider handle offset angle 214 that is adapted to the natural hand and arm position of the second rider 304 in the back section between reference lines 208 and 210 proximate the right side edge 116. The ends of the second rider's handles 126 are fastened to the upper layer 140. The second rider's handles 126 are accessible to a second rider 304.

In step 2008, the first rider handles 102 can be orientated. In this regard, the angle of the first rider handles 102A and 102C are measured with respect to the center reference line 202 and are in the range of 15 degrees to 45 degrees, preferably 25 degrees to 35 degrees, and most preferably 30 degrees with respect to the center reference line 202. The angled first rider handles 102A and 102C provide a natural gripping position for the first rider 302 that creates a more enjoyable riding experience.

In step 2010, the second rider handles 126 can be orientated. In this regard, the angle of the second rider handles 126A and 126B are measured with respect to the center reference line 202 and are in the range of 5 degrees to 35 degrees, preferably 10 degrees to 25 degrees, and most preferably 15 degrees with respect to the center reference line 202. The angled second rider handles 126A and 126B provide a natural gripping position for the second rider 304 that creates a more enjoyable riding experience.

In step 2012, a camera 106 can be attached to a camera mount 108 that is located in the front section between reference lines 204 and 206 proximate the leading edge 112 of the tandem surf bodyboard 100. In a plurality of other exemplary embodiments, there can be one or more of the camera 106 and camera mount 108 located in various other locations and positions associated with the tandem surf bodyboard 100, as may be required and/or desired in a particular embodiment.

In step 2014, one or more items selected from the list of an air pump 402, a maintenance kit 404, and a carry bag 406 can be added or otherwise combined with a tandem surf bodyboard 100 to form a tandem surf bodyboard kit.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

To the extent the present application discloses a system, the method implemented by that system is within the scope of the present invention. Further, to the extent, the present application discloses a method, a system of apparatuses configured to implement the method are within the scope of the present invention.

It should be understood, of course, that the foregoing relates to exemplary embodiments of the invention and that modifications may be made without departing from the spirit and scope of the present invention.

What is claimed is:

1. An inflatable tandem surf bodyboard comprising:

a base that is cut into shape of a surf bodyboard;

a base fabric layer is applied over and secured to top side of the base;

an intermediate portion material forms an air chamber that is defined by circumference of the intermediate portion material, bottom side of the intermediate portion material is affixed to the base fabric layer, the air chamber is traversed by plurality of a drop-stitch that sets inflatable dimensions of the air chamber allowing higher air pressures that increase buoyance and rigidity of the inflatable tandem surf bodyboard;

an upper layer is fastened to top side, right side, and left side of the intermediate portion material;

a deck pad layer is applied over and secured to outer surface of the upper layer;

a first rail layer is applied around perimeter of the surf bodyboard sealing edges of the base, the base fabric layer, the upper layer, and the deck pad layer; and a second rail layer is applied over the first rail layer around perimeter of the surf bodyboard.

2. The tandem surf bodyboard in accordance with claim 1, the drop-stitch forms a V-shaped stitching pattern that is vertically orientated across the air chamber to increase engineering strength and reduce shear force movement.

3. The tandem surf bodyboard in accordance with claim 1, the surf bodyboard having a top, a bottom, a left side, and a right side, a front section, a middle section, and a back section, the front section having a leading edge, and the back section having an inward curvature edge proximate perimeter between the left side and the right side.

4. The tandem surf bodyboard in accordance with claim 3, the inward curvature edge having contoured corners with a radius in range of 16 inches to 22 inches, the inward curvature edge is in range of 1.25 inches to 3.25 inches.

5. The tandem surf bodyboard in accordance with claim 3, further comprising:

an air inlet, the air inlet is accessible externally and traverses the deck pad layer, the upper layer, and portion of the intermediate portion material entering the air chamber, the air inlet interconnects with an air pump, the air inlet having a valve to retain pressurized air inside the air chamber.

6. The tandem surf bodyboard in accordance with claim 3, further comprising:

a camera mount for attaching a camera is located in the front section proximate to the leading edge of the surf bodyboard.

7. The tandem surf bodyboard in accordance with claim 3, further comprising:

more than one of a first rider handle, at least one of the first rider handle is orientated horizontally and centrally located in the front section proximate to the leading edge, plurality of the first rider handle are orientated vertically at a first rider handle offset angle in the front section proximate to edge of the left side and edge of the right side, ends of the first rider handle are fastened to the upper layer, the first rider handle is accessible to a first rider.

8. The tandem surf bodyboard in accordance with claim 1, the first rider handle offset angle is in range of 10 to 20 degrees measured from a vertical center reference line.

9. The tandem surf bodyboard in accordance with claim 3, further comprising:

more than one of a second rider handle, plurality of the second rider handle are orientated vertically at a second rider handle offset angle in the back section proximate to edge of the left side and edge of the right side, ends of the second rider handle are fastened to the upper layer, the second rider handle is accessible to a second rider.

10. The tandem surf bodyboard in accordance with claim 9, the second rider handle offset angle is in range of 0 to 10 degrees measured from a vertical center reference line.

11. The tandem surf bodyboard in accordance with claim 3, the leading edge having contoured corners with a radius in range of 4 inches to 8 inches.

12. The tandem surf bodyboard in accordance with claim 1, the tandem surf bodyboard dimension is in range of 33 inches to 40 inches in width and 45 inches to 58 inches in length, and 3.5 to 5.5 inches in thickness.

13. The tandem surf bodyboard in accordance with claim 1, the tandem surf bodyboard inflation pressure is in range of 7 psi to 13 psi.

14. An inflatable tandem surf bodyboard kit comprising:

an air pump; and a surf bodyboard comprising:

a base that is cut into shape of a surf bodyboard having a top, a bottom, a left side, and a right side, a front section, a middle section, and a back section, the front section having a leading edge, and the back section having an inward curvature edge proximate perimeter between the left side and the right side;

a base fabric layer is applied over and secured to the top of the base;

an intermediate portion material forms an air chamber that is defined by circumference of the intermediate portion material, bottom side of the intermediate portion material is affixed to the base fabric layer, the air chamber is traversed by plurality of a drop-stitch that sets inflatable dimensions of the air chamber allowing higher air pressures that increase buoyance and rigidity of the surf bodyboard;

an upper layer is fastened to the top side, the right side, and the left side of the intermediate portion material;

a deck pad layer is applied over and secured to outer surface of the upper layer;

a first rail layer is applied around perimeter of the surf bodyboard sealing edges of the base, the base fabric layer, the upper layer, and the deck pad layer;

a second rail layer is applied over the first rail layer around perimeter of the surf bodyboard; and an air inlet, the air inlet is accessible externally and traverses the deck pad layer, the upper layer, and portion of the intermediate portion material entering the air chamber, the air inlet interconnects with the air pump, the air inlet having a valve to retain pressurized air inside the air chamber.

15. The tandem surf bodyboard kit in accordance with claim 14, further comprising:

more than one of a first rider handle, at least one of the first rider handle is orientated horizontally and centrally located in the front section proximate to the leading edge, plurality of the first rider handle are orientated vertically at a first rider handle offset angle in the front section proximate to edge of the left side and edge of the right side, ends of the first rider handle are fastened to the upper layer, the first rider handle is accessible to a first rider.

16. The tandem surf bodyboard kit in accordance with claim 14, further comprising:

more than one of a second rider handle, plurality of the second rider handle are orientated vertically at a second rider handle offset angle in the back section proximate to edge of the left side and edge of the right side, ends of the second rider handle are fastened to the upper layer, the second rider handle is accessible to a second rider.

17. The tandem surf bodyboard kit in accordance with claim 14, further comprising:

a maintenance kit for repairing and maintaining the surf bodyboard; and a carry bag for storing and carrying the air pump, the surf bodyboard, and the maintenance kit.

18. A method of making an inflatable tandem surf bodyboard comprising the steps:

cutting a base into shape of a surf bodyboard;

applying a base fabric layer over and securing the base fabric layer to top side of the base;

forming an air chamber by way of an intermediate portion material, the air chamber is defined by circumference of the intermediate portion material, bottom side of the intermediate portion material is affixed to the base fabric layer, the air chamber is traversed by plurality of a drop-stitch that sets inflatable dimensions of the air chamber allowing higher air pressures that increase buoyance and rigidity of the inflatable tandem surf bodyboard, the air inlet having a valve to retain pressurized air inside the air chamber;

fastening an upper layer to top side, right side, and left side of the intermediate portion material;

applying a deck pad layer over and securing the deck pad layer to outer surface of the upper layer;

applying a first rail layer around the perimeter of the surf bodyboard sealing edges of the base, the base fabric layer, the upper layer, and the deck pad layer; and applying a second rail layer over the first rail layer around perimeter of the surf bodyboard.

19. The method in accordance with claim 18, further comprising the step of:

attaching more than one of a first rider handle, the surf bodyboard having a top, a bottom, a left side, and a right side, a front section, a middle section, and a back section, the front section having a leading edge, and the back section having an inward curvature edge proximate perimeter between the left side and the right side, at least one of the first rider handle is orientated horizontally and centrally located in the front section proximate to the leading edge, plurality of the first rider handle are orientated vertically at a first rider handle offset angle in the front section proximate to edge of the left side and edge of the right side, ends of the first rider handle are fastened to the upper layer, the first rider handle is accessible to a first rider.

20. The method in accordance with claim 19, further comprising the step of:

more than one of a second rider handle, plurality of the second rider handle are orientated vertically at a second rider handle offset angle in the back section proximate to edge of the left side and edge of the right side, ends of the second rider handle are fastened to the upper layer, the second rider handle is accessible to a second rider.

* * * * *